US010546679B2

(12) United States Patent
Kim

(10) Patent No.: US 10,546,679 B2
(45) Date of Patent: Jan. 28, 2020

(54) INDUCTOR

(71) Applicant: SAMSUNG ELECTRO-MECHANICS CO., LTD., Suwon-si, Gyeonggi-do (KR)

(72) Inventor: Jae Hun Kim, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 17 days.

(21) Appl. No.: 15/634,282

(22) Filed: Jun. 27, 2017

(65) Prior Publication Data

US 2018/0174729 A1 Jun. 21, 2018

(30) Foreign Application Priority Data

Dec. 21, 2016 (KR) ..... 10-2016-0176100

(51) Int. Cl.

| | |
|---|---|
| ***H01F 5/00*** | (2006.01) |
| ***H01F 27/02*** | (2006.01) |
| ***H01F 27/29*** | (2006.01) |
| ***H01F 27/28*** | (2006.01) |

(52) U.S. Cl.

CPC ..... *H01F 27/022* (2013.01); *H01F 27/2804* (2013.01); *H01F 27/29* (2013.01); *H01F 2027/2809* (2013.01)

(58) Field of Classification Search

CPC ..... H01F 17/0013; H01F 27/022; H01F 27/2804; H01F 27/29; H01F 27/292; H01F 27/323; H01F 27/255; H01F 2027/2809; H01F 2027/2842

USPC ..... 336/200, 223, 233

See application file for complete search history.

(56) References Cited

U.S. PATENT DOCUMENTS

| | | | | |
|---|---|---|---|---|
| 2005/0195062 | A1 | 9/2005 | Yoshida et al. | |
| 2006/0001518 | A1* | 1/2006 | Hayashi | G01D 5/2046 336/200 |
| 2010/0164665 | A1* | 7/2010 | Sevakivi | H01F 5/00 336/61 |
| 2015/0155093 | A1 | 6/2015 | Kim et al. | |

(Continued)

FOREIGN PATENT DOCUMENTS

| | | | |
|---|---|---|---|
| CN | 1661738 | A | 8/2005 |
| CN | 202102827 | U | 1/2012 |

(Continued)

OTHER PUBLICATIONS

Korean Office Action issued in corresponding Korean Patent Application No. 10-2016-0033462, dated Oct. 30, 2017, with English Translation.

(Continued)

*Primary Examiner* — Mang Tin Bik Lian

(74) *Attorney, Agent, or Firm* — Morgan, Lewis & Bockius LLP

(57) ABSTRACT

An inductor includes a body including a support member, a coil supported by the support member, and an encapsulant encapsulating the support member and the coil, the coil including a plurality of coil patterns continuously connected to each other and at least some portion of a cross section of the coil pattern having a wavy shape, and external electrodes disposed on an outer surface of the body and electrically connected to the coil.

18 Claims, 6 Drawing Sheets

(56) References Cited

U.S. PATENT DOCUMENTS

| | | | | |
|---|---|---|---|---|
| 2015/0170823 | A1* | 6/2015 | Jeong | C25D 7/001 336/200 |
| 2016/0086720 | A1 | 3/2016 | Jeong | |
| 2016/0104564 | A1 | 4/2016 | Jeong | |
| 2016/0104565 | A1* | 4/2016 | Nishiyama | H01F 17/0013 336/200 |
| 2018/0090266 | A1* | 3/2018 | Sano | H01F 27/2804 |

FOREIGN PATENT DOCUMENTS

| | | | | |
|---|---|---|---|---|
| CN | 104700982 | A | | 6/2015 |
| CN | 105513747 | A | | 4/2016 |
| JP | 2003-142323 | A | | 5/2003 |
| JP | 2010-045126 | A | | 2/2010 |
| JP | 2010045126 | A | * | 2/2010 |
| JP | 2012-161136 | A | | 8/2012 |
| KR | 10-1999-0066108 | A | | 8/1999 |
| KR | 10-2016-0033462 | A | | 3/2016 |

OTHER PUBLICATIONS

Office Action issued in Chinese Patent Application No. 201710669171.7 dated Jul. 3, 2019, with English translation.

* cited by examiner

INDUCTOR

CROSS-REFERENCE TO RELATED APPLICATION(S)

This application claims the benefit of priority to Korean Patent Application No. 10-2016-0176100, filed on Dec. 21, 2016 with the Korean Intellectual Property Office, the disclosure of which is incorporated herein by reference in its entirety.

TECHNICAL FIELD

The present disclosure relates to an inductor and, more particularly, to a thin-film type power inductor offering a small size and high inductance.

BACKGROUND

In accordance with the development of information technology (IT), miniaturization and thinness of an apparatus have been accelerated, and market demand for small, thin devices has increased.

The following disclosure provides a power inductor including a substrate having a via hole, so as to meet the requirements of this technical trend, and coils disposed on both surfaces of the substrate and electrically connected to each other through the via hole of the substrate in order to provide an inductor having a uniform coil with a large aspect ratio. However, due to limitations in manufacturing processes, there is still a limitation in forming a uniform coil with a large aspect ratio.

SUMMARY

An aspect of the present disclosure may provide an inductor capable of having structural stability and reliability in an entire structure while providing a coil with a high aspect ratio.

According to an aspect of the present disclosure, an inductor may include: a body including a support member, a coil supported by the support member, and an encapsulant encapsulating the support member and the coil; and external electrodes disposed on an outer surface of the body and electrically connected to the coil. The coil may include a plurality of coil patterns continuously connected to each other, wherein at least some portion of a cross section of the coil pattern has a wavy shape.

BRIEF DESCRIPTION OF THE DRAWINGS

The above and other aspects, features, and advantages of the present disclosure will be more clearly understood from the following detailed description, taken in conjunction with the accompanying drawings, in which.

DETAILED DESCRIPTION

Hereinafter, exemplary embodiments of the present disclosure will be described in detail with reference to the accompanying drawings.

Hereinafter, an inductor according to exemplary embodiments of the present disclosure will be described, but the disclosure not necessarily limited thereto.

Figure 1:
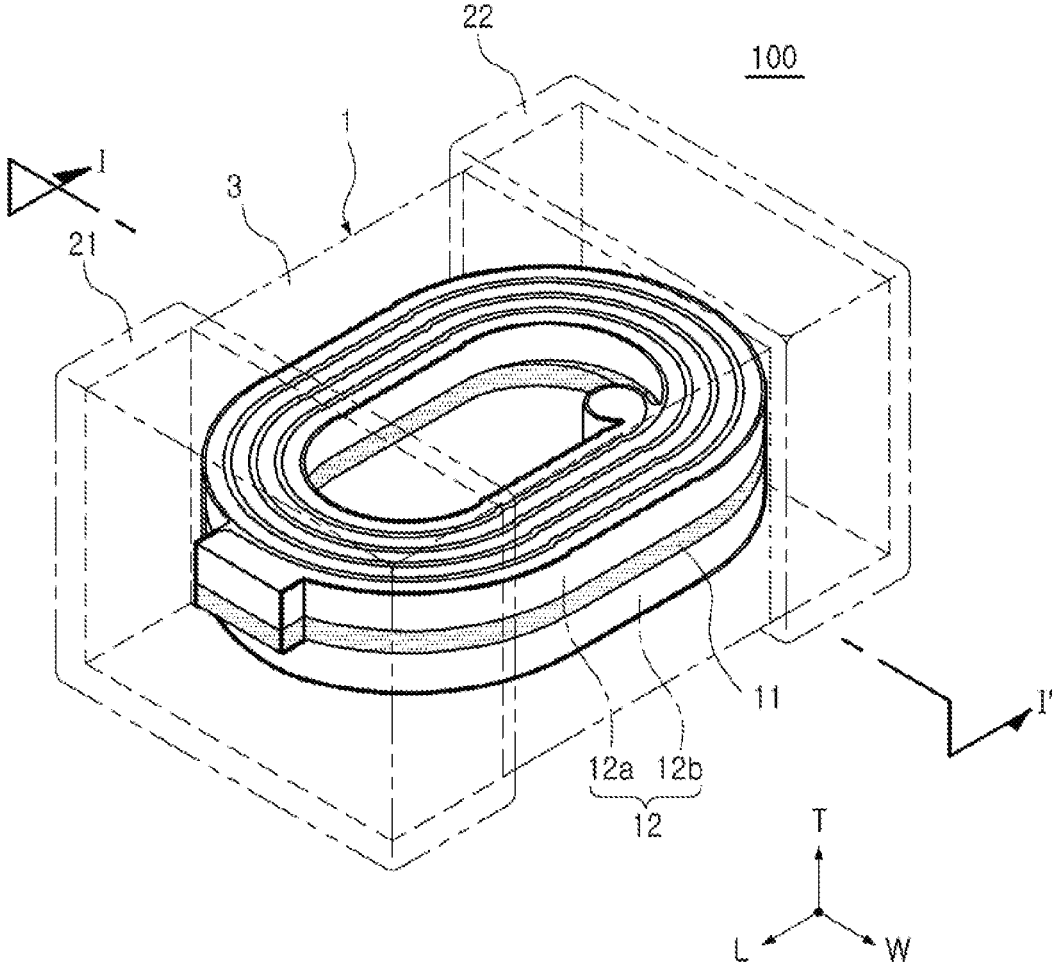
FIG. 1 is a perspective view of an inductor according to exemplary embodiments of the present disclosure.

FIG. 1 is a perspective view of an inductor according to exemplary embodiments of the present disclosure.

Referring to FIG. 1, an inductor 100 according to an exemplary embodiment may include a body 1 and first and second external electrodes 21 and 22 disposed on an outer surface of the body.

The body 1 may form an exterior of the inductor, have upper and lower surfaces opposing each other in a thickness (T) direction, first and second end surfaces opposing each other in a length (L) direction, and first and second side surfaces opposing each other in a width (W) direction, and be substantially a hexahedron in shape. However, the body 1 is not limited thereto.

The body 1 may include a support member 11, a coil 12 supported by the support member, and an encapsulant 13 encapsulating the support member and the coil. Here, the encapsulant may be disposed to simultaneously embed, or encapsulate, the support member and the coil.

The encapsulant 13 may contain magnetic particles having magnetic characteristics. The encapsulant 13 may be formed of, for example, ferrite or a material in which metal magnetic particles are filled into a resin, wherein the metal magnetic particle may contain one or more selected from the group consisting of iron (Fe), silicon (Si), chromium (Cr), aluminum (Al) and nickel (Ni).

The support member 11 encapsulated by the encapsulant will be described. The purpose of the support member 11 is to form the coil more thinly and easily. The support member may be an insulating substrate formed of an insulating resin. Here, as the insulating resin, a thermosetting resin such as an epoxy resin, a thermoplastic resin such as polyimide, or resins in which a reinforcement material, such as a glass fiber or an inorganic filler, may be used. As the thermoplastic resin, such as polyimide, or resins in which a reinforcement material, such as a glass fiber or an inorganic filler, impregnated in the thermosetting resin, and the thermoplastic resin, for example, a prepreg, an ajinomoto build-up film (ABF), FR-4, a bismaleimide triazine (BT) resin, a photoimageable dielectric (PID) resin, or the like, may be used. When the glass fiber is contained in the support member, rigidity may be excellent. A through hole may be formed in a central portion of the support member and filled with a magnetic material, thereby forming a core part.

The coil 12, encapsulated together with the support member by the encapsulant, will now be described. The coil 12 may be formed on both upper and lower surfaces of the support member and composed of upper and lower coils 12*a* and 12*b*, as illustrated in FIG. 1. The upper and lower coils may be electrically connected to each other through a via, or aperture, (V) penetrating through the upper and lower surfaces of the support member. As a result, the upper and lower coils may be electrically connected to each other to form a single coil.

Although not illustrated, each of the upper and lower coils 12*a* and 12*b* may include a seed layer and a plating layer disposed on the seed layer, such that a boundary line may be confirmed in each of the upper and lower coils. A method of forming the seed layer is not limited thereto. For example, the seed layer may be formed by forming a resist pattern on a chemical copper plating surface, performing an etching, and then stripping a resist, or may be formed using a $CO_2$ laser process method. In a case of using the $CO_2$ laser processing method, each of the coil patterns in the upper and lower coils may include a seed layer and a plating layer disposed on the seed layer and having the same cross-sectional shape as that of the seed layer.

Further, each of the upper and lower coils of the coil 12 may include a plurality of coil patterns, and the plurality of coil patterns may be continuously connected to each other, thereby in their entirety forming a single coil. For example, each of the upper and lower coils may include an innermost coil pattern close to the center of the core of the coil and an outermost coil pattern close to an outer side portion of the core.

At least some portion of a cross section of the coil pattern included in the coil may have a wavy shape. This is to improve structural reliability of the coil supported by the support member.

Figure 2:
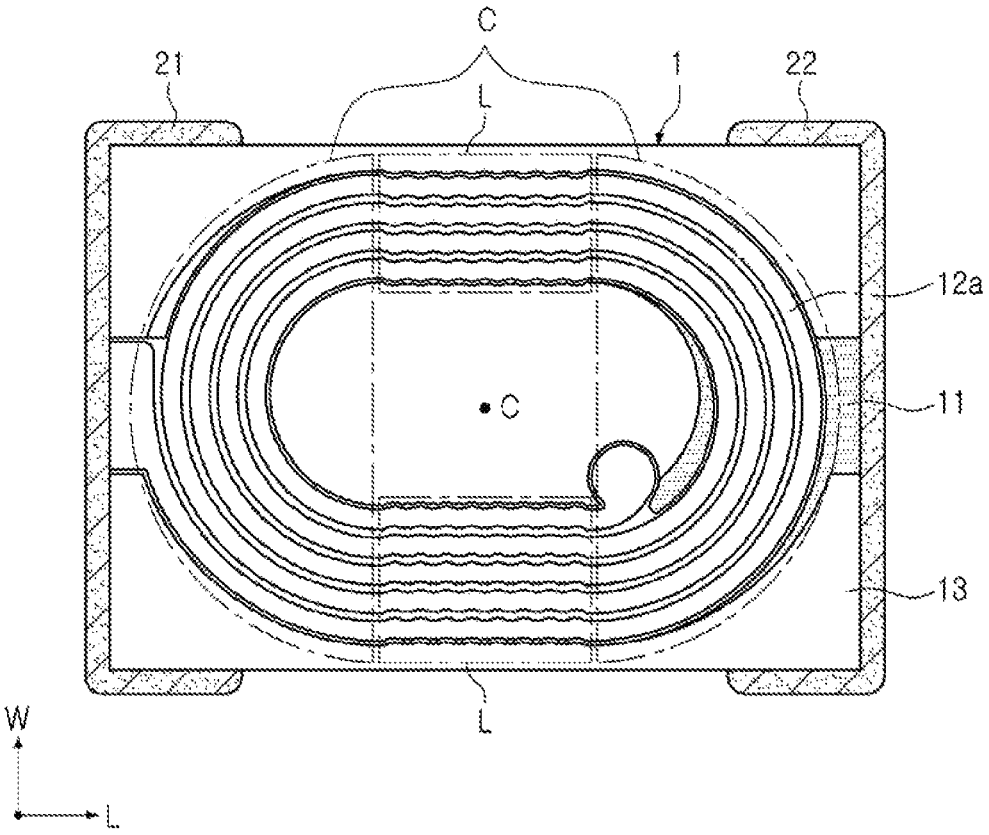
FIG. 2 is a top view of a coil in the inductor of FIG. 1.

The at least some portion of the cross section of the coil pattern having the wavy shape will be described in detail with reference to FIG. 2. FIG. 2 is a top view of the coil in the inductor of FIG. 1, viewed from above.

Referring to FIG. 2, the coil may alternately include a linear region L and a curved region C, and configure a continuous pattern by the linear region and the curved region.

At least some portion of the cross section of the coil pattern may have the wavy shape, wherein "at least some portion of the cross section of the coil pattern" means at least some portion of a cutting plane obtained by cutting some region of the continuously formed coil pattern so as to be parallel with a contact surface between the coil and the support member. The contact surface between the coil and the support member may be disposed to be parallel with a surface of the body 1 in an L-W direction.

Since, in the coil having the structure illustrated in FIG. 2, at least some portion of the cross section of the coil pattern may have the wavy shape, a contact area of the coil pattern with the support member per unit length of the coil pattern may be increased. As a result, even though an aspect ratio (AR) of the coil pattern is increased, a structural reliability problem caused by collapse of the coil pattern may be effectively prevented. A mechanism capable of increasing the contact area of the coil pattern with the support member per unit length of the coil pattern, in the case of allowing at least some portion of the cross section of the coil pattern to have the wavy shape described above, will be described with reference to FIGS. 3A and 3B.

Figure 3A:
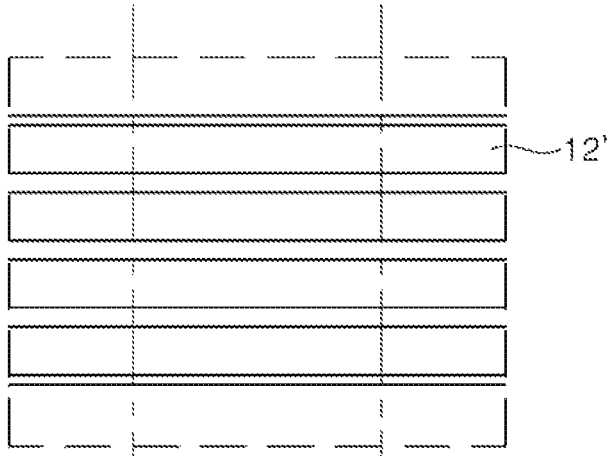
FIGS. 3A and 3B are views in which a cross section of a coil pattern is a tetragonal shape and in which a cross section of the coil pattern has a wavy shape, respectively.
Figure 3B:
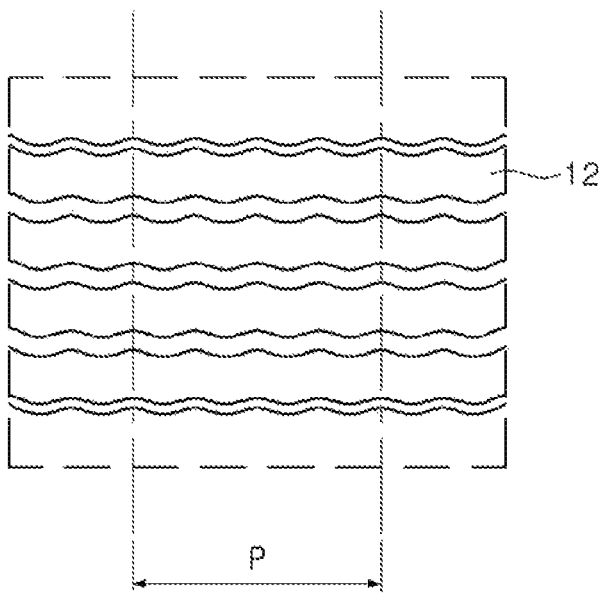

FIG. 3A, which illustrates a cross section of a general coil pattern, illustrates a plurality of coil patterns (12') having an entirely tetragonal shape, and FIG. 3B, which illustrates the cross section of the coil pattern (12) according to an exemplary embodiment in the present disclosure, illustrates a plurality of coil patterns having a wavy shape. When it is assumed that lower surfaces of the plurality of coil patterns of FIGS. 3A and 3B are supported by the support member, it is clear that a contact area of the coil pattern of FIG. 3A with the support member per unit length P of the coil pattern is smaller than a contact area of the coil pattern of FIG. 3B with the support member per unit length P of the coil pattern.

Again referring to FIG. 2, a region of the coil pattern in which the cross section of the coil pattern has the wavy shape is included in the linear region of the coil. The reason is that a risk of deformation of the coil pattern is relatively high in the linear region, as compared to the curved region. This is related to the fact that if a width of the coil is entirely uniform, a contact area of the coil pattern with the support member per unit length P of the coil pattern in the linear region L of the coil is smaller than that in the curve region C of the coil.

The regions in which the cross section of the coil pattern has the wavy shape may be symmetrically disposed in the linear regions L facing each other, based on the center of the core.

Disposition positions of the regions in which the cross section of the coil pattern has the wavy shape may be suitably determined by those skilled in the art in consideration of the required characteristics, for example, a size of the inductor, a direct current resistance (Rdc) value, the aspect ratio of the coil pattern, or the like, may be suitably determined by those skilled in the art.

Although not illustrated, the region in which the cross section of the coil pattern has the wavy shape may also be included in the curved region.

The wavy shape is not specifically limited thereto, as long as the wavy shape has a structure in which crests and troughs are repeated, and thus a positive radius of curvature and a negative radius of curvature are repeated. In this case, specific shapes of the crest and trough are not limited. For example, the crest and trough may be formed to be curved, or to have a sharp point, etc. It is important to allow the crest and trough to have a shape capable of increasing the contact area between the coil and the support member, based on the same area.

Figure 4:
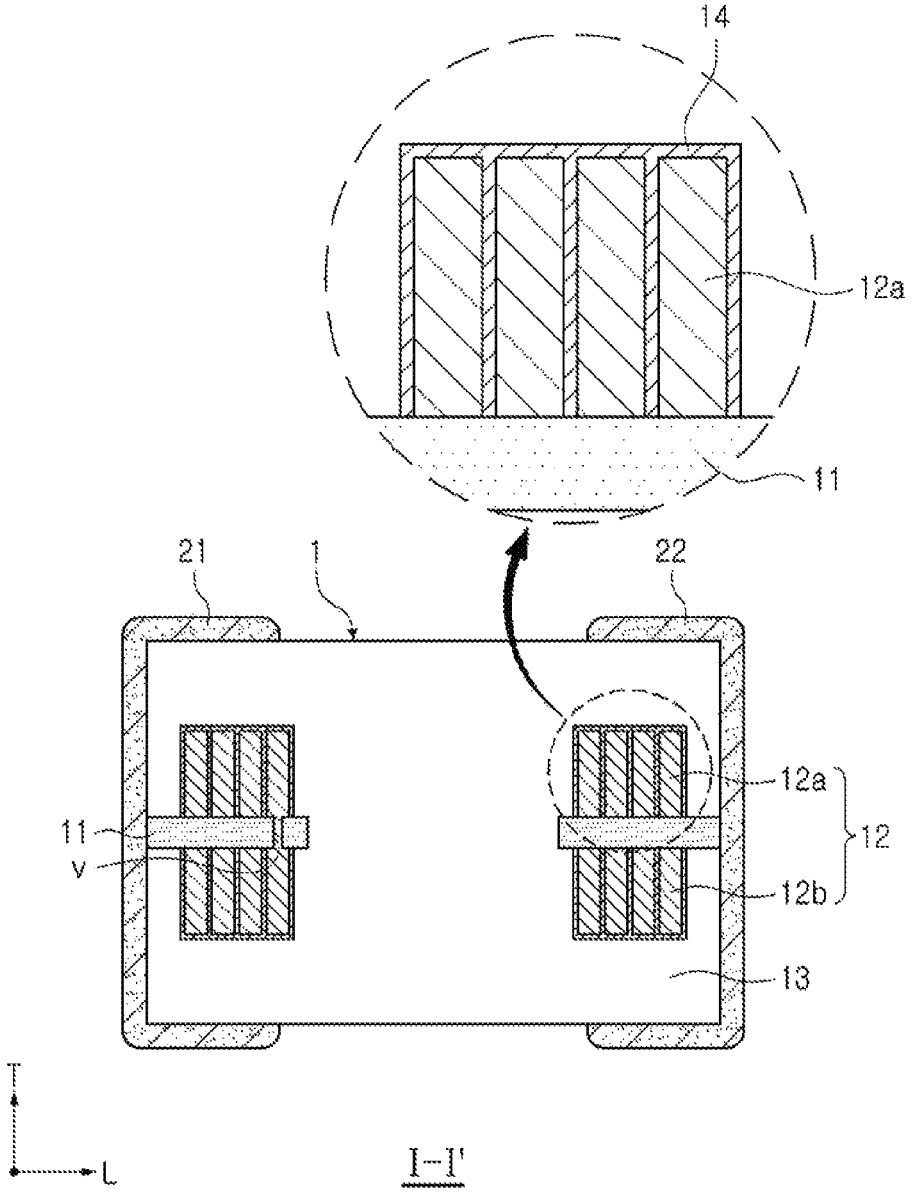
FIG. 4 is a cross-sectional view taken along line I-I' of FIG. 1.

FIG. 4 is a cross-sectional view taken along line I-I' of FIG. 1. Referring to FIG. 4, the coil pattern in the coil 12 may be insulated from another coil pattern adjacent thereto by an insulator 14 disposed on a surface of the coil pattern.

The insulator 14 may be formed of any material as long as it has insulation characteristics. For example, the insulator may contain an epoxy based resin, a polyimide based resin, a phenoxy resin, a polysulfone resin, a polycarbonate resin, and/or a perylene resin.

A thickness of the insulator 14 may be suitably determined. However, the thickness of the insulator 14 may be 1 μm or more to 10 μm or less, inclusive. In a case in which the thickness of the insulator is less than 1 μm, a leakage current may be generated due to damage of an insulating film, and a short-circuit between the coils may occur, and in a case in which the thickness of the insulator is more than 10 μm, inductance characteristics may be deteriorated. Although a case in which the insulator disposed between coil patterns adjacent to each other completely fills a space between the coil patterns throughout, from the bottom to the top of the coil pattern, is illustrated in FIG. 4, the insulator is not limited thereto. For example, as long as the surface of the coil pattern is coated with the insulator, in a case in which a spare space s is secured between the coil patterns coated by the insulator, by sufficiently decreasing the thickness of the insulator, the encapsulant may be additionally filled in the secured, spare space.

Figure 5:
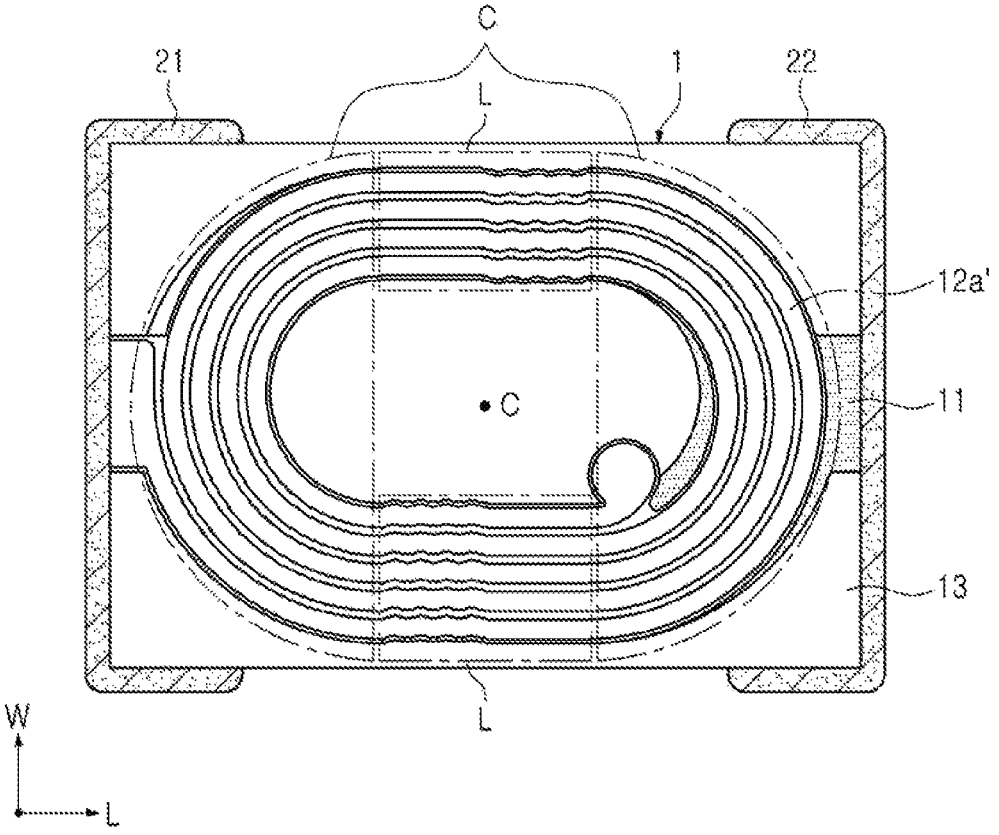
FIG. 5 is a schematic top view of a modified example of the inductor of FIG. 2.

Next, FIG. 5 is a top view of a modified example of the inductor of FIG. 2. The inductor of FIG. 5 is different from the inductor of FIG. 2 in that the region of the coil in which at least some portion of the cross section of the coil pattern has a wavy shape is reduced.

For convenience of explanation, a description of contents of the inductor of FIG. 5 overlapping those of the already described inductor of FIG. 2 will be omitted.

Referring to FIG. 5, the regions in which the cross section of the coil pattern has a wavy shape may be included in linear regions of a coil 12', but disposed to be point-symmetric to each other, based on the center C of a core of the coil 12'.

In a case in which a continuous length of the linear region of the coil is not long or an aspect ratio of the coil is not large, and thus there are relatively few factors deteriorating reliability such as collapse or bending of the pattern of the coil, or the like, a scale of the region in which the cross section of the coil pattern has a wavy shape may be selectively reduced.

Figure 6:
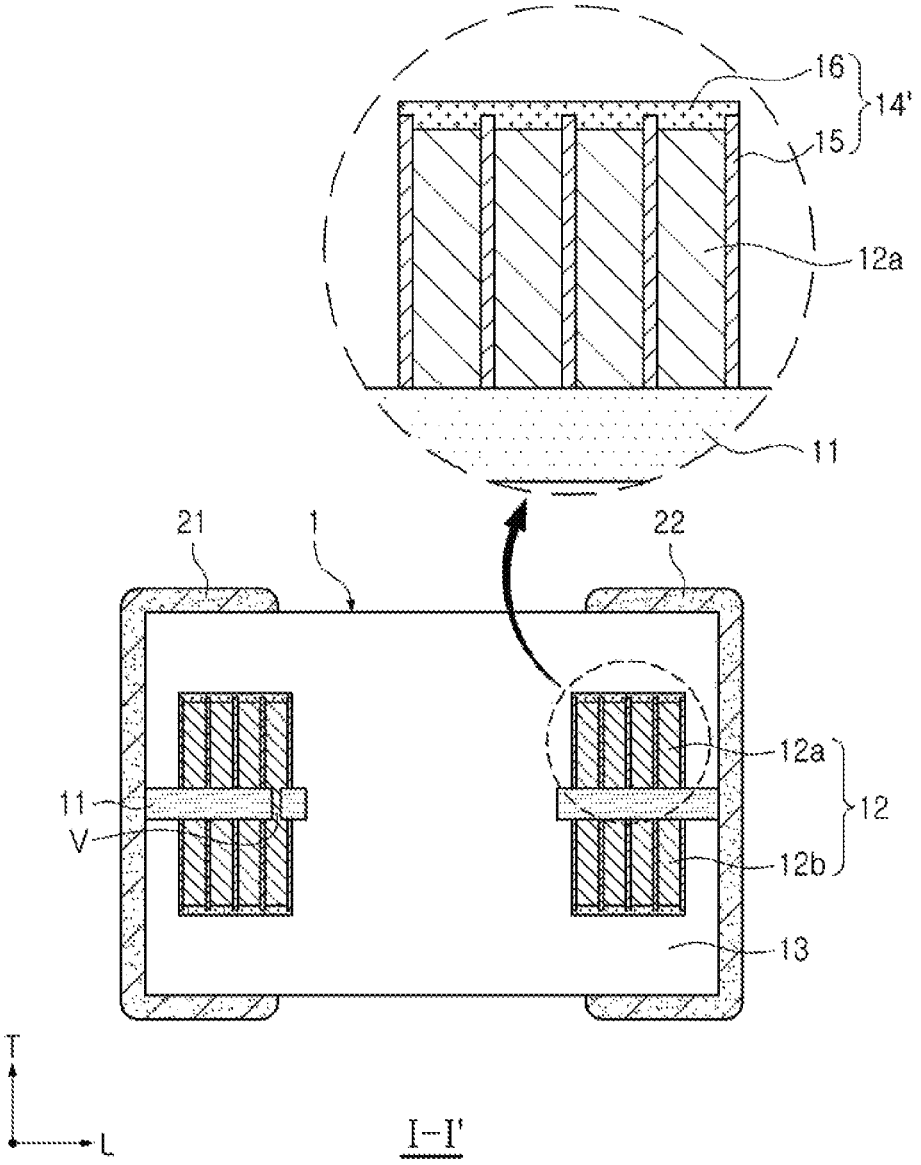
FIG. 6 is a cross-sectional view of a modified example of the inductor of FIG. 4.

FIG. 6 is a cross-sectional view of a modified example of the inductor of FIG. 4. The inductor of FIG. 6 is different from the inductor of FIG. 4 in that a structure of the insulator is changed.

For convenience of explanation, a description of contents of the inductor of FIG. 6 overlapping those of the already described inductor of FIG. 4 will be omitted.

Referring to FIG. 6, an insulator 14' coated on a coil pattern to insulate the coil pattern from a coil pattern adjacent thereto may include an insulating wall 15 and an insulating layer 16 disposed on an upper surface of the insulating wall.

Since the insulating wall 15 has a structure in which the insulating wall fills a space between coil patterns adjacent each other, side surfaces of the coil pattern may have substantial contact with a side surface of the insulating wall.

The insulating wall 15 may have an entirely open-hole pattern, and the coil pattern may be plated and filled in the open-hole pattern. The insulating wall may serve as a plating growth guide at the time of plating the coil pattern, and an aspect ratio of the coil pattern may be significantly increased by the insulating wall. For example, the aspect ratio of the coil may be 1 or more to 8 or less, inclusive. If the aspect ratio of the coil is less than 1, which does not satisfy the recent trend toward increasing the aspect ratio of the coil, an effect of improving electrical characteristics, for example, a decrease in Rdc, or the like, may not be sufficiently secured. Further, in a case in which the aspect ratio is more than 8, it may be difficult to uniformly control a plating deviation of the coil, or the like.

Since FIG. 6 illustrates a cross-sectional view of the coil, a case in which at least some region of the insulating wall 15 has a wavy shape, depending on a shape of the coil pattern contacting the insulating wall 15, is not illustrated. However, since the insulating wall 15 fills the space between the coil patterns adjacent to each other, when the cross sections of the coil patterns adjacent to each other have a wavy shape, at least some region of the open-hole pattern of the insulating wall may also have the wavy shape.

When at least some region of the open-hole pattern of the insulating wall 15 has the wavy shape, structural stability of the insulating wall may be improved.

When the insulating wall 15, serving as the plating growth guide of the coil pattern, has a high aspect ratio, in accordance with the technical trend of increasing a number of turns of the coil in a limited space. For example, the aspect ratio of the insulating wall may be 10 or more to 30 or less, inclusive. When the aspect ratio of the insulating wall is less than 10, there is a limitation in increasing the number of turns of the coil, and when the aspect ratio of the insulating wall is more than 30, it may be difficult to implement the open-hole pattern of the insulating wall in the technical aspect of a process.

Since the insulating wall 15 has a significantly, or relatively, high aspect ratio, as described above, at the time of performing the plating on the seed layer positioned between the open-hole patterns of the insulating wall, in order to obtain the plating layer, the insulating wall may not maintain an initial arrangement but instead may be bent or may collapse. A cause of deterioration of the structural reliability of the insulating wall may be, for example, interfacial strength of the plating layer filled between the open-hole patterns of the insulating wall, or the like, but is not limited thereto.

However, since at least some portion of the open-hole pattern of the insulating wall, adjacent to the coil pattern of the inductor, according to exemplary embodiments of the present disclosure, has the wavy shape, close adhesion between the insulating wall and the support member supporting the insulating wall may be increased. A mechanism to increase close adhesion is the same as the mechanism to increase close adhesion between the coil pattern and the support member supporting the coil pattern.

Therefore, even though the insulating wall has a high aspect ratio, structural stability may be secured.

Meanwhile, the insulating wall 15 may be formed of a single layer or a double layer composed of a first insulating wall disposed adjacent the support member and a second insulating wall disposed on the first insulating wall. When the insulating wall 15 is formed of the double layer, the first insulating wall may contain a photoimageable dielectric (PID) material capable of being stripped by a stripping solution. For example, the first insulating wall may contain a photosensitive material containing a cyclic ketone compound and an ether compound having a hydroxyl group as main ingredients, wherein the cyclic ketone compound may be, for example, cyclopentanone, or the like, and the ether compound having a hydroxyl group may be, for example, polypropylene glycol monomethyl ether, or the like. However the cyclic ketone compound and the ether compound are not limited thereto. Any photosensitive material may be used as long as it may be stripped easily by the stripping solution. The second insulating wall disposed on the first insulating wall may contain a permanent type photosensitive insulating material, for example, a photosensitive material containing a bisphenol based epoxy resin, as an ingredient. When the insulating wall 15 is formed of the single layer, the insulating wall may contain a bisphenol based epoxy resin as a permanent type photosensitive insulating material.

Further, an upper surface of the insulating wall 15 may be disposed to be higher than an upper surface of the coil pattern adjacent thereto. In this case, the shorter the distance from the upper surface of the insulating wall to the upper surface of the coil pattern adjacent thereto, the higher the aspect ratio of the coil. Meanwhile, although not illustrated, the upper surface of the insulating wall and the upper surface of the coil pattern adjacent thereto may have a same height as each other. A method of allowing the upper surface of the insulating wall and the upper surface of the coil pattern adjacent thereto to have the same height is not limited thereto. For example, a polishing method, or the like, may be used.

Next, the insulating layer 16, disposed on the insulating wall, will be described. In terms of content, since the insulating layer 16 is an insulator added to insulate the upper surface of the coil pattern, a specific material of the insulating layer and a method of forming the insulating layer are not limited thereto. For example, the insulating layer may contain a curable epoxy resin, but the insulating layer is not limited thereto. Further, the insulating layer may be formed using a dipping method, a chemical vapor deposition method, a sputtering method, or the like, but a forming method is not limited thereto.

According to exemplary embodiments of the present disclosure described above, the inductor including the coil having a high aspect ratio may be stably formed and structurally improved, and, as a result, Rdc characteristics, and the like, may be significantly improved.

As set forth above, according to exemplary embodiments of the present disclosure, the inductor including the structurally stable coil pattern having a high aspect ratio may be provided.

While exemplary embodiments have been shown and described above, it will be apparent to those skilled in the art that modifications and variations could be made without departing from the scope of the present invention, as defined by the appended claims.

What is claimed is:

1. An inductor, comprising:

a body including a support member, a coil supported by the support member, and an encapsulant encapsulating the support member and the coil, the coil including a plurality of coil patterns continuously connected to each other and at least one linear region of a cross section of the coil pattern having a wavy shape; and external electrodes disposed on an outer surface of the body and electrically connected to the coil, wherein the cross-section of the coil pattern having the wavy shape is parallel to a surface of the support member on which the coil is disposed.

2. The inductor of claim 1, wherein the coil includes a plurality of linear regions, including the at least one linear region, and a plurality of curved regions, the linear regions and the curved regions being alternately disposed to form a continuous pattern.

3. The inductor of claim 2, wherein the at least one linear region includes a portion which does not have the wavy shape.

4. The inductor of claim 3, wherein a length of a coil pattern included in a first region in which the cross section of the coil pattern has the wavy shape in the at least one linear region is longer than a length of a coil pattern included in said portion of the at least one linear region.

5. The inductor of claim 2, wherein, based on the center of a core of the coil, the plurality of linear regions face each other and the plurality of curved regions face each other.

6. The inductor of claim 1, wherein the coil pattern is insulated from the coil pattern adjacent thereto by an insulator disposed on a surface of the coil pattern.

7. The inductor of claim 6, wherein the insulator includes an insulating wall and an insulating layer disposed on an upper surface of the insulating wall.

8. The inductor of claim 7, wherein the insulating wall fills a space between the coil patterns contacting the insulating wall.

9. The inductor of claim 7, wherein an aspect ratio of the insulating wall is from 10 to 30, inclusive.

10. The inductor of claim 7, wherein the upper surface of the insulating wall has a height greater than or equal to that of an upper surface of the coil pattern contacting the insulating wall.

11. The inductor of claim 7, wherein the insulating wall contains a bisphenol based epoxy resin.

12. The inductor of claim 1, wherein an aspect ratio of the coil is from 1 to 8, inclusive.

13. The inductor of claim 1, wherein the coil includes an upper coil disposed on one surface of the support member and a lower coil disposed on the other surface of the support member, opposing the one surface of the support member, the upper and lower coils being electrically connected to each other through a via penetrating through the support member.

14. The inductor of claim 1, wherein the encapsulant contains a resin and a magnetic powder dispersed in the resin.

15. The inductor of claim 1, wherein the coil pattern includes a seed layer and a plating layer disposed on the seed layer, the seed layer having the same cross-sectional shape as the plating layer disposed thereon.

16. An inductor, comprising:

a body including a support member, a coil supported by the support member, and an encapsulant encapsulating the support member and the coil, the coil including a plurality of coil patterns continuously connected to each other, at least some portion of a linear region of the coil includes a cross section having a wavy shape and at least another portion of the linear region of the coil includes a cross section not having the wavy shape; and external electrodes disposed on an outer surface of the body and electrically connected to the coil, wherein the cross-section having the wavy shape is parallel to a surface of the support member on which the coil is disposed.

17. The inductor of claim 16, wherein the linear region of the coil is disposed adjacent at least one curved region of the coil.

18. The inductor of claim 16, wherein the linear region of the coil is disposed adjacent two curved regions of the coil.

* * * * *